US007392622B2

(12) United States Patent
Back et al.

(10) Patent No.: US 7,392,622 B2
(45) Date of Patent: Jul. 1, 2008

(54) CONSERVATORY ROOF WITH A SOFFIT SYSTEM

(75) Inventors: Mark A. Back, Surfside Beach, SC (US); John Michael Riley, Swinton (GB)

(73) Assignee: Park Lane Conservatories Limited, Salford (GB)

( * ) Notice: Subject to any disclaimer, the term of this patent is extended or adjusted under 35 U.S.C. 154(b) by 554 days.

(21) Appl. No.: 10/689,326

(22) Filed: Oct. 20, 2003

(65) Prior Publication Data

US 2004/0134134 A1 Jul. 15, 2004

Related U.S. Application Data

(60) Provisional application No. 60/420,293, filed on Oct. 22, 2002.

(51) Int. Cl.
*E04B 7/02* (2006.01)

(52) U.S. Cl. ..... 52/90.1; 52/11; 52/15; 52/94

(58) Field of Classification Search ..... 52/15, 52/11, 90.1, 95, 94
See application file for complete search history.

(56) References Cited

U.S. PATENT DOCUMENTS

| | | | | |
|---|---|---|---|---|
| 2,245,689 | A | 6/1941 | Krueger | |
| 3,150,463 | A | 9/1964 | Nearing et al. | |
| 3,344,566 | A * | 10/1967 | Miles et al. | 52/94 |
| 3,363,390 | A | 1/1968 | Crane et al. | |
| 3,456,410 | A | 7/1969 | Olson et al. | |
| 3,866,381 | A | 2/1975 | Eschbach et al. | |
| 4,057,941 | A | 11/1977 | Schwartz | |
| 4,068,437 | A | 1/1978 | Byxbe et al. | |
| 4,075,811 | A | 2/1978 | Keith | |
| 4,261,143 | A | 4/1981 | Rizzo | |
| 4,327,532 | A | 5/1982 | Matthews | |
| 4,373,312 | A | 2/1983 | Kim | |
| 4,443,508 | A | 4/1984 | Mehl | |
| 4,455,803 | A | 6/1984 | Kornberger | |
| 4,461,128 | A * | 7/1984 | Knoebl | 52/94 |
| 4,462,390 | A | 7/1984 | Holdridge et al. | |
| 4,527,370 | A | 7/1985 | Schuette | |
| 4,621,467 | A | 11/1986 | Golden | |
| 4,784,902 | A | 11/1988 | Crompton | |

(Continued)

FOREIGN PATENT DOCUMENTS

| | | |
|---|---|---|
| DE | 8601745.4 | 2/1987 |

(Continued)

OTHER PUBLICATIONS

Park Lane Roof Systems, *Step By Step Guide to Installation—Victorian 5 Face*, Feb. 1996.

(Continued)

*Primary Examiner*—Basil Katcheves
(74) *Attorney, Agent, or Firm*—Wood, Herron & Evans, LLP

(57) ABSTRACT

An external soffit system for a conservatory roof which prevents unwelcome insects or birds from forming nests and provides a more aesthetically appealing appearance of the conservatory. The soffit also provides a platform from which lights or speakers may be mounted. The soffit and supporting structure also provide added protection to the conservatory roof structure from the elements.

1 Claim, 3 Drawing Sheets

U.S. PATENT DOCUMENTS

| | | | |
|---|---|---|---|
| 4,872,297 | A | 10/1989 | Hetzel et al. |
| 4,928,425 | A | 5/1990 | Walker, Jr. et al. |
| 4,970,102 | A | 11/1990 | Guillon |
| 5,036,833 | A | 8/1991 | Quigley et al. |
| 5,058,333 | A | 10/1991 | Schwartz |
| 5,060,291 | A | 10/1991 | Albertelli |
| 5,140,768 | A | 8/1992 | Forbes |
| 5,209,031 | A | 5/1993 | Tavano |
| 5,215,805 | A | 6/1993 | Pavia, Jr. |
| 5,349,796 | A | 9/1994 | Meyerson |
| 5,394,664 | A | 3/1995 | Nowell |
| 5,509,250 | A | 4/1996 | Jensen et al. |
| 5,533,312 | A | 7/1996 | Mihalcheon |
| 5,589,243 | A | 12/1996 | Day |
| 5,749,197 | A | 5/1998 | Jolly |
| 5,826,380 | A | 10/1998 | Wolfe |
| 5,834,082 | A | 11/1998 | Day |
| 5,927,027 | A | 7/1999 | Richardson |
| 6,000,176 | A | 12/1999 | Lancaster |
| 6,119,410 | A | 9/2000 | Wolfe |
| 6,151,845 | A | 11/2000 | Lancaster |
| 6,185,877 | B1 | 2/2001 | Lloyd |
| 6,223,481 | B1 | 5/2001 | Rickman |
| 6,298,619 | B1 | 10/2001 | Davie |
| 6,631,594 | B2 | 10/2003 | Whiting |
| 2001/0029708 | A1 | 10/2001 | Richardson |
| 2003/0233796 | A1 | 12/2003 | Walz et al. |

FOREIGN PATENT DOCUMENTS

| | | | |
|---|---|---|---|
| EP | 0513934 | A1 | 11/1992 |
| EP | 0644305 | B1 | 3/1995 |
| FR | 2757891 | A | 7/1998 |
| GB | 2204627 | B | 7/1991 |
| GB | 2256880 | A | 12/1992 |
| GB | 2275948 | A | 9/1994 |
| GB | 2287493 | A | 9/1995 |
| GB | 2267298 | B | 2/1996 |
| GB | 2283997 | B | 1/1997 |
| GB | 2288827 | A | 11/1997 |
| GB | 2314875 | A | 1/1998 |
| GB | 2316421 | A | 2/1998 |
| GB | 2347944 | A | 9/2000 |
| GB | 2376961 | A | 12/2002 |

OTHER PUBLICATIONS

Park Lane Roof Systems, *Park Lane Conservatory Roofs Data Sheet*.
Park Lane Roof Systems, *Roof Vents Data Sheet*.
Park Lane Roof Systems, *Park Lane Wide Span Data Sheet*.
Park Lane Roof Systems, *Park Lane WIDE-span Assembly Instructions*, 1999.
Park Lane Roof Systems, *Prestige Data Sheet*.
Park Lane Roof Systems, *Elite Data Sheet*.
Park Lane Roof Systems, *Elite Roof Kits Data Sheet*.
Park Lane Roof Systems, *Elite Conservatory Roofing System Assembly Instructions*, Jan. 2001.
Park Lane Roof Systems, *Elite Conservatory Roofing System Brochure*.
Park Lane Roof Systems, *Step By Step Guide to Installation—Victorian 3 Face*, Feb. 1996.
Park Lane Roof Systems, *Highlight 600 Brochure*.
Park Lane Roof Systems, *Park Lane Conservatory Roof Systems Brochure*.
Park Lane Roof Systems, *Step By Step Guide to Installation—EDWARDIAN*.
Park Lane Roof Systems, *Park Lane Series II Assembly Instructions*, 1999.
Park Lane Roof Systems, *Park Lane Roof Systems Brochure*, Jul. 1995.
Park Lane Roof Systems, *Park Lane Brochure*.
Park Lane Roof Systems, *ELITE Conservatory Roofing Systems Document*.
Park Lane Roof Systems, *25* "Wide Span" Conservatories Document*.
Park Lane Roof Systems, *25* Fixed Pitch Conservatory Roof Document*.
Park Lane Roof Systems, *Park Lane Variable Pitch Conservatory Roof Document*.
Aluminum Profiles and Accessories Ltd., *Conservatory and Roofing System Handbook* (1991).

* cited by examiner

CONSERVATORY ROOF WITH A SOFFIT SYSTEM

CROSS-REFERENCE TO RELATED APPLICATIONS

The present application claims the benefit of U.S. provisional application Ser. No. 60/420,293, filed Oct. 22, 2002, the disclosure of which is hereby incorporated herein by reference in its entirety.

BACKGROUND OF THE INVENTION

Conservatory rooms have typically been formed from metal frames and glass or transparent plastic panels. The roofs were formed from a series of rafters which supported transparent glass or weather-resistant plastic (e.g., polyvinylchloride) panels between the rafters. The roof end of the rafters and panels often extend beyond the side walls creating an overhang. Generally, these roofs did not incorporate gutters.

The roof overhangs can provide an inviting nesting location for birds and insects such as wasps and bees. Once established in the recessed corner of the overhangs, where the under-section of the roof meets the eaves beam, it can be difficult to eliminate these pests and prevent their return. Moreover, bird droppings and stinging insects often pose emotional and physical health concerns to individuals.

It is also important to make the roof attractive. Generally, plastic trim is used to cover exposed edges of supports and the like.

SUMMARY OF THE INVENTION

The present invention provides a soffit system which addresses the problems associated with an exposed conservatory roof overhang and provides for a gutter system. Specifically, a soffit is mounted between the eaves beam and the edge of the roof overhang, thus creating a closed space under the overhang.

By enclosing the space under the overhang, pests are prevented from accessing and nesting in the corner recesses of the overhang.

The present invention also provides an attractive appearance in the eaves portion of the roof and provides a gutter system. The added protection afforded by the present invention may lengthen the life of the conservatory and reduce periodic maintenance costs.

Finally, the present invention provides the architectural option of creating a conservatory with a different external appearance and functionality. For example, the soffit can be configured to hold external lights or speakers, can hide wiring or other conduits, or can contain vents. The present invention thus contributes both aesthetic as well as functional value.

The objects and advantages of the present invention will be further appreciated in light of the following detailed drawings and descriptions.

DETAILED DESCRIPTION OF THE INVENTION

Figure 1:
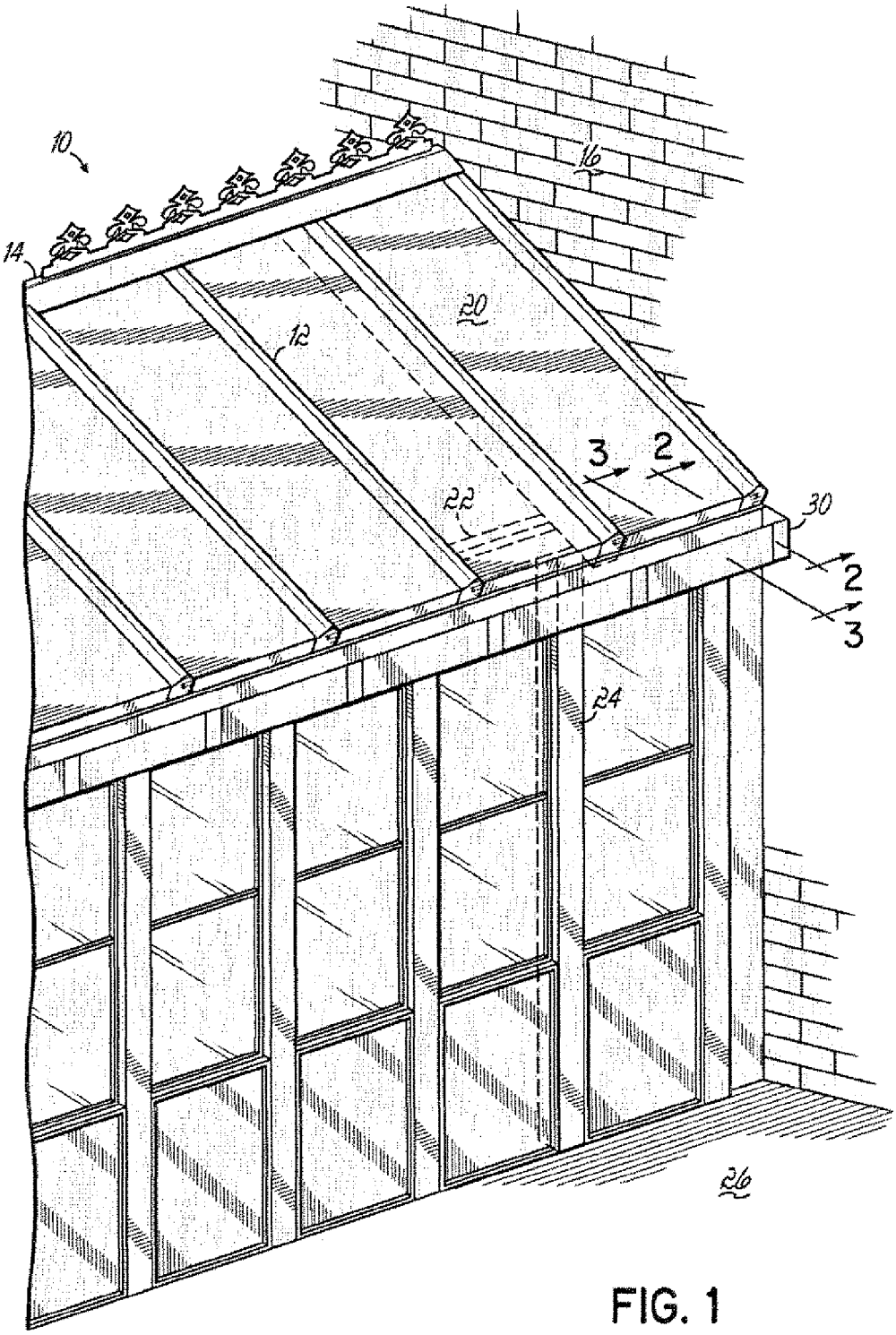
FIG. 1 is a perspective view of a conservatory roof with supporting posts according to the present invention.

As shown in FIG. 1, the present invention is a conservatory roof 10 having a plurality of rafters 12 which generally attach at an upper end to a ridge beam 14 which, as shown, extends outwardly from a wall of a house or other building 16. Rafters 12 extend from the ridge beam 14 to an eaves beam 22. Between individual rafters 12 are panels 20 which constitute the majority of the sloped surface area of the conservatory's roof 10.

The eaves beam 22, in turn, is supported by a plurality of posts or mullions 24. The posts or mullions 24 rest upon the ground, floor, or similar foundational structure 26.

Figure 2:
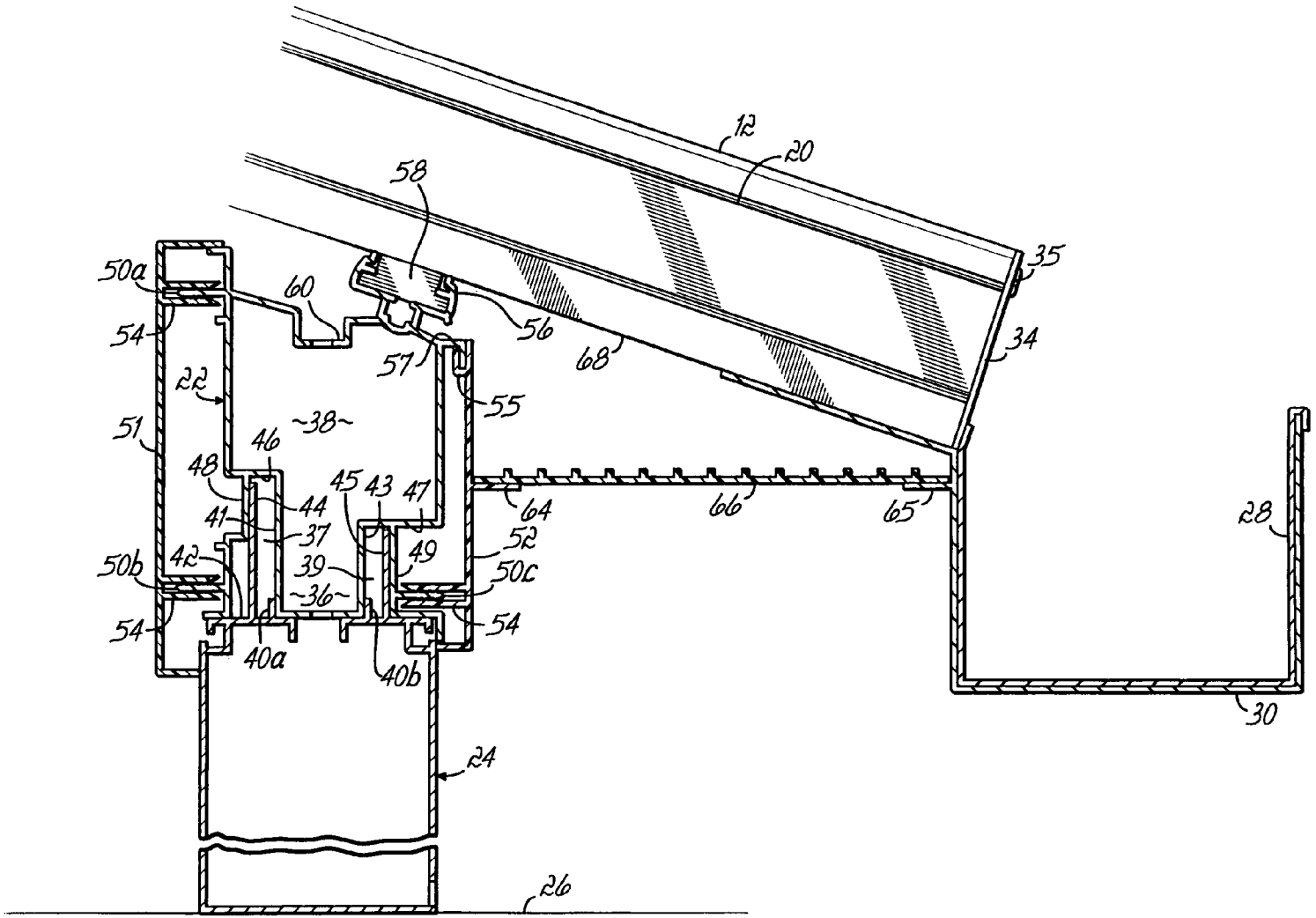
FIG. 2 is a cross-sectional view of lines 2-2 of FIG. 1.

As shown in FIG. 2, the posts or mullions 24 contain parallel vertical guide tabs 40*a* and 40*b*. Nested between guide tabs 40*a* and 40*b* is the lower section 36 of the eaves beam 22. The parallel guide tabs 40*a* and 40*b* are generally centrally located on the posts or mullions 24, and are separated from each other by a distance approximating the exterior width of the lower section 36 of the eaves beam 22. These guide tabs 40*a* and 40*b* prevent horizontal movement of the eaves beam 22 and act as a guide to place and attach the eaves beam 22 on the posts or mullions 24.

The lower section 36 of the eaves beam 22 includes a first and second channel 37, 39. A first part of the guide tabs 40*a* and 40*b* engages walls 41, 43 of these channels. Exteriorly of the guide tabs 40*a* and 40*b*, a parallel set of tabs 44, 45 extends vertically upward from the top wall 42 of the posts or mullions 24. These tabs 44, 45 engage walls 48, 49 of channels 37, 39, centering the eaves beam 22 on the posts or mullions 24.

In the preferred embodiment, these tabs 44, 45 extend higher than the guide tabs 40*a* and 40*b* and generally to the respective levels of the bottom surfaces 46, 47 of the upper section 38 of the eaves beam 22. The tabs 44, 45 can guide and support the positioning, placement, and securement of the eaves beam 22 to the posts or mullions 24. The eaves beam 22 can be secured to the posts or mullions 24 with a screw or other suitable fastener. In the preferred embodiment, walls 48, 49 also include trim mounting barbs 50*a*, 50*b*, 50*c*. An interior finishing trim plate 51 containing channel receptacles 54 can be attached to the barbs 50*a*, 50*b*.

An exterior finishing trim plate or mounting arm 52, containing a channel receptacle 54 and a coupling arm 55, is attached to the eaves beam 22. The coupling arm 55 of the exterior finishing trim plate 52 locks with an opposing coupling arm 57 attached to the eaves beam 22 while the channel receptacle 54 snaps onto the barb 50*c*, thus securing the exterior finishing trim plate 52 to the eaves beam 22.

The eaves beam 22 further contains a sloped C-bracket 56 which matches the slope of the roof 10. The C-bracket 56 holds a support member 58 which, in the preferred embodiment, is made from plastic. The rafters 12 rest on the support member 58.

Figure 3:
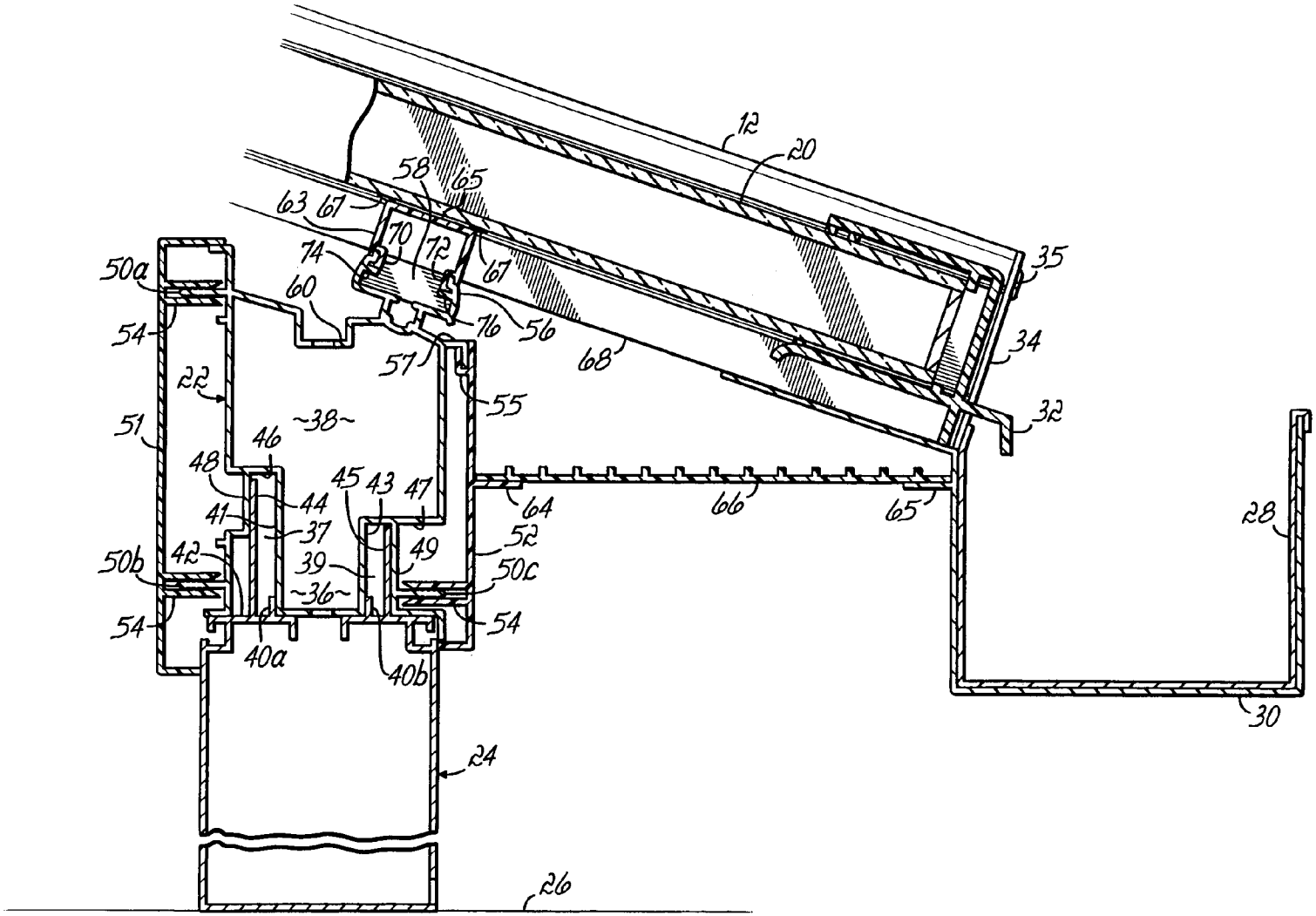
FIG. 3 is a cross-sectional view taken of lines 3-3 of FIG. 1.

As shown in FIG. 3, an opposing C-shaped channel 63 is attached to the C-bracket 56 via parallel sets of opposing coupling appendages 70, 72, 74, 76. Coupling appendages 70, 72, attached to C-shaped channel 63, snap into coupling appendages 74, 76, attached to C-bracket 56, thus securing the C-shaped channel 63 to the C-bracket 56. Attached to the uppermost outside surface 65 of the C-shaped channel 63 is a pair of rubber glazing members 67. Channel 63 runs between adjacent rafters. The panels 20 in turn rest on the rubber glazing members 67.

The top of the eaves beam 22 contains a groove or channel 60 which runs the entire length of the eaves beam 22 and is able to collect moisture that runs down along the rafters 12. The groove or channel 60 is apertured to allow accumulated water to flow interiorly downward with the eaves beam 22 and the posts or mullions 24 to the ground 26 below.

A plurality of gutter brackets or hangers 30 are attached with a screw, bolt, or other like fastener to the lower side of the rafters 12. A gutter 28 runs the length of the roof, supported by gutter hangers 30. The ends of the rafters are protected by end caps 34 which are attached to the rafters 12 by a bolt or screw 35. Drip edges 32 can be mounted to the panels 20 in such a way as to drain external moisture into the gutter 28.

The exterior finishing trim plate 52 contains a generally horizontal ledge or arm 64 which supports one edge of a soffit 66. The other edge of the soffit 66 is supported by horizontal tabs 65 which extend inwardly from gutter hangers 30. The soffit 66 may be attached to either the exterior finishing trim plate 52 or the gutter brackets 30, or both. In the preferred embodiment, the soffit 66 is made from vinyl and can have any desired ornamental appearance.

When the soffit 66 is in place, the bottom side 68 of the roof's 10 overhang is protected. This also provides a location or hollow to hide wires or conduits used for telephone, television, computer, electrical, or other purposes. Alternative embodiments could provide for vents, lights, or speakers in the soffit 66. This has been a description of the present invention and the preferred mode of practicing the invention. However, the invention itself should only be defined by the claims, wherein:

We claim:

1. A conservatory roof system comprising:

a generally horizontal and longitudinal eaves beam;

a sloped roof, the sloped roof having a plurality of sloped rafters attached to, and supported by, the eaves beam, and a plurality of sloped conservatory panels positioned between, and supported by, the rafters, the roof extending exteriorly of the eaves beam whereby an overhang is created, the overhang having an underside portion;

a mounting arm contiguously attached to, and supported by, the eaves beam, the mounting arm having an integral vertical external trim plate with an integral horizontal ledge extending perpendicularly and exteriorly therefrom;

a plurality of gutter hangers attached to the rafters exteriorly of the eaves beam, the gutter hangers having integral horizontal tabs;

a gutter positioned in and supported by the gutter hangers;

a generally horizontal vinyl soffit paralleling and running along the length of the eaves beam, the soffit resting upon and being supported by the horizontal ledge of the mounting arm and the horizontal tabs of the gutter hangers;

wherein a triangularly shaped hollow is formed under the overhang and wherein the soffit protects the underside portion of the overhang portion of the roof.

* * * * *